US005184916A

United States Patent [19]

Thoer

[11] Patent Number: 5,184,916

[45] Date of Patent: Feb. 9, 1993

[54] BEACH CLEANING MACHINE

[76] Inventor: Jean C. Thoer, 90 avenue de Verdun, 92390 Villeneuve la Garenne, France

[21] Appl. No.: 830,901

[22] Filed: Feb. 4, 1992

[30] Foreign Application Priority Data

Feb. 5, 1991 [FR] France ..... 91 01275

[51] Int. Cl.[5] ..... C09L 17/00; B09B 1/00

[52] U.S. Cl. ..... 405/128; 37/8; 37/9; 405/129; 405/258

[58] Field of Search ..... 405/128, 129, 21, 258, 405/303; 37/8, 9, 96; 34/10; 210/170, 923; 404/92

[56] References Cited

U.S. PATENT DOCUMENTS

| | | | |
|---|---|---|---|
| 1,841,339 | 1/1932 | Schroder . | |
| 3,159,270 | 12/1964 | Johnston . | |
| 3,308,563 | 3/1967 | Danek | 37/8 X |
| 3,484,961 | 12/1969 | Coslowsky | 37/8 X |
| 4,837,950 | 6/1989 | Vesper | 37/8 X |
| 4,913,586 | 4/1990 | Gabbita | 405/129 |
| 4,927,293 | 5/1990 | Campbell | 405/128 |
| 4,993,498 | 2/1991 | Fresnel | 37/8 X |
| 5,039,415 | 8/1991 | Smith | 405/128 X |

FOREIGN PATENT DOCUMENTS

| | | |
|---|---|---|
| 0319420 | 6/1989 | European Pat. Off. . |
| 2446939 | 4/1976 | Fed. Rep. of Germany . |
| 2350283 | 12/1977 | France . |
| 1538389 | 1/1979 | United Kingdom . |

*Primary Examiner*—Dennis L. Taylor

*Attorney, Agent, or Firm*—Sandler, Greenblum & Bernstein

[57] ABSTRACT

Beach cleaning machine comprises a self-propelled vehicle carrying a tippable skip and at the front an apron adapted to pivot about an axis perpendicular to the longitudinal axis of the machine. The inclination of the apron can be varied and its lower forward end is provided with a blade adapted to dig into the ground. To the rear of the blade, extends a first grid conveyor discharging onto a conveyor belt adapted to convey detritus picked up by the apron to the skip. Above the first grid conveyor is a second grid conveyor provided with paddles and whose upper end is pivoted to one end of two links whose other ends are pivoted to the apron. Rams are coupled to the links intermediate their ends. The lower end of the second grid conveyor is connected to the apron by rams. The second grid conveyor is driven by a motor in an opposite direction to the first grid conveyor. The apron is in two parts, an upper part and a lower part. Each part comprises a grid conveyor driven by a motor. The lower part comprises at is forward lower end the blade and its upper part extends over the upper part. The lower part is slidably mounted on the upper part and can occupy two positions, an operative position in which the two apron parts are disposed one in front of the other and a transport position in which the two apron parts are stacked one on top of the other.

17 Claims, 9 Drawing Sheets

FIG.2
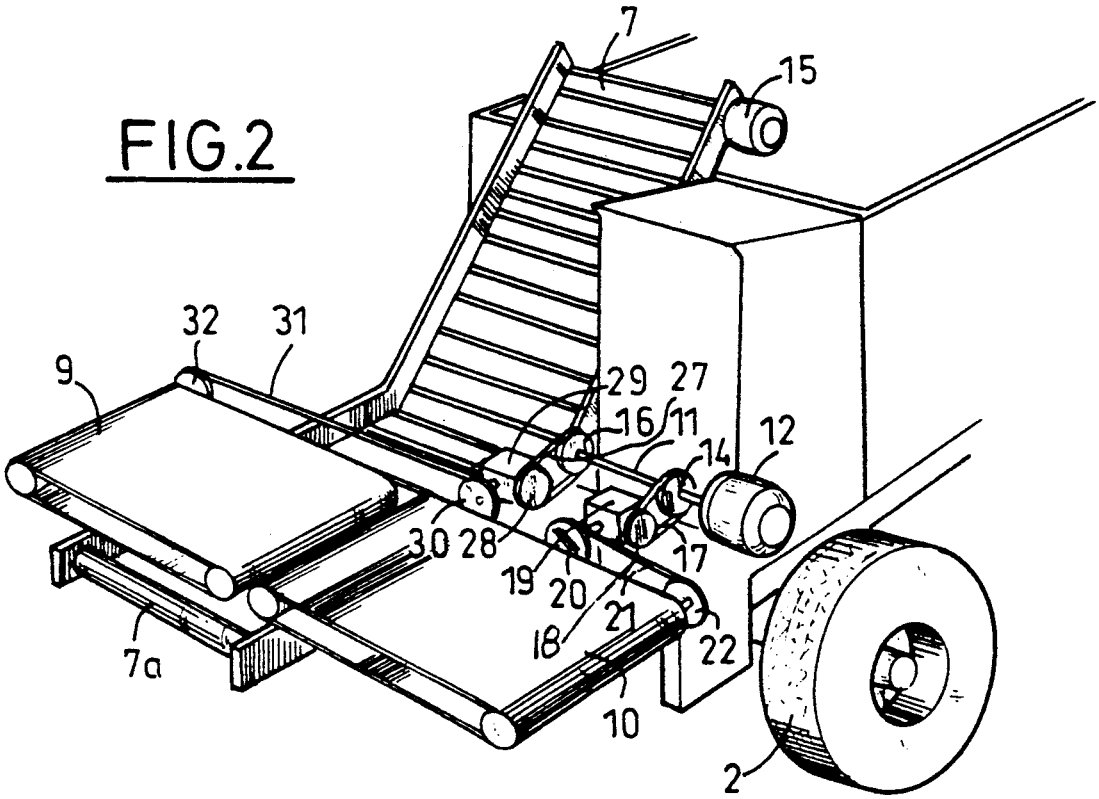
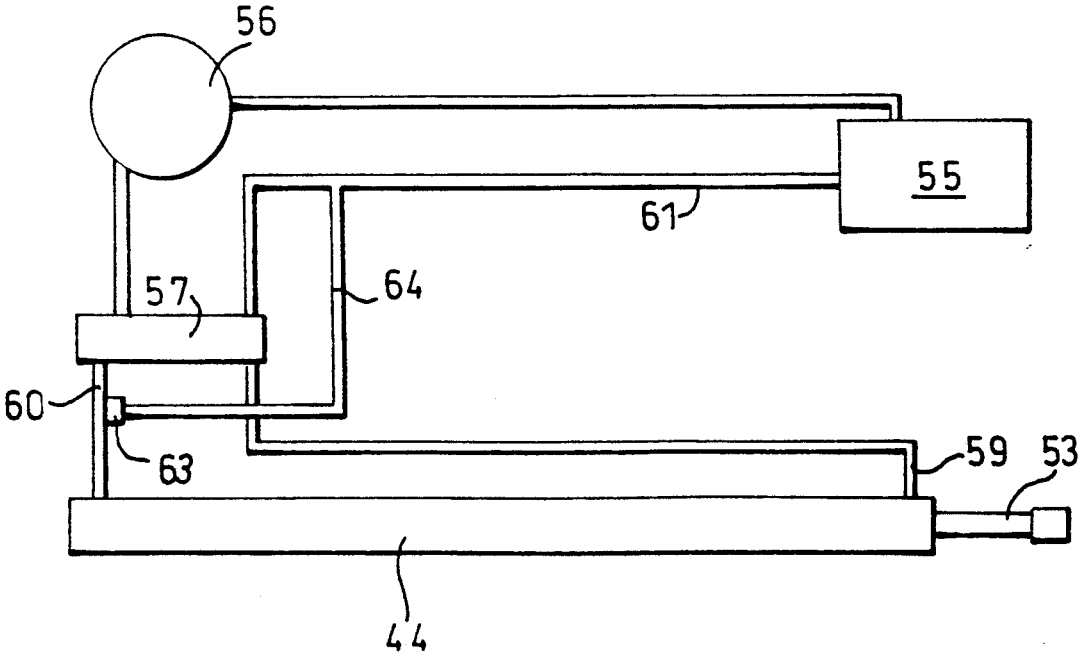
FIG.10

BEACH CLEANING MACHINE

BACKGROUND OF THE INVENTION

1. Field of the Invention

The invention concerns a machine for cleaning beaches.

2. Description of the Prior Art

A known beach cleaning machine comprises a self-propelled vehicle carrying a tippable skip, a front-mounted apron adapted to pivot about an axis perpendicular to a longitudinal axis of the machine, means for adjusting the inclination of the apron whose lower forward end is provided with a blade adapted to dig into the sand and to the rear of which extends a first grid conveyor discharging onto a conveyor belt adapted to convey detritus picked up by the apron to the skip, drive means for the conveyor, a second grid conveyor above the first grid conveyor provided with paddles and whose upper end is pivoted to one end of two links whose other ends are pivoted to the apron, rams operating on the links, rams operative between the lower end of the second grid conveyor and the apron and a motor adapted to drive said the grid conveyor in the opposite direction to the first grid conveyor.

A machine of this kind has a number of drawbacks. In particular, seaweed and other material picked up from beaches are viscous and sticky so that sand adheres to it. Therefore, this known machine picks up a significant quantity of sand.

It is desirable that only a little sand should be picked up with this material. First, only a small amount of sand should be picked up because sand is heavy and rapidly fills the skip. Second, if too much sand is picked up, a significant quantity of sand may be removed from the beach, whereby a shortage of sand may result.

Another drawback of a machine of this kind is that it is difficult to drive, especially on roads.

SUMMARY OF THE INVENTION

One object of the invention is to overcome the disadvantages of known machines.

It is an object of the present invention to provide a beach cleaning machine comprising a self-propelled vehicle carrying a tippable skip, a front-mounted apron having an upper apron part and a lower apron part each comprising a respective portion of a two-part motor-driven first grid conveyor, and a blade at a lower forward end of the lower apron part adapted to dig into sand; the lower apron part having an upper rear and overlying the upper apron part with the lower apron part being slidably mounted; displacement means for moving the lower apron part relative to the upper apron part between an operative position in which the lower apron part and the upper apron part are disposed one substantially in front of the other, and a transport position in which the lower apron part and the upper apron part are substantially stacked one on top of the other; a conveyor belt discharging into the skip and onto which the first grid conveyor discharges; and a second grid conveyor above and adapted to be driven in an opposite direction to the first grid conveyor, paddles on the second grid conveyor, links pivoted at one end to the second grid conveyor and at the other end to the front-mounted apron, rams adapted to displace the links and rams operative between the front-mounted apron and a lower end of the second grid conveyor.

With this design, when the machine is operated on a beach the various objects picked up by the lower part and transported by the second grid conveyor are turned over as they fall onto the upper part so that a very small quantity of sand is carried with them. In the transport configuration, the various parts are stacked on top of each other which facilitates operation on roads.

The means for displacing the lower part relative to the upper part are preferably rams disposed between the upper part and the lower part.

The rams disposed between the upper part and the lower part are preferably included in a circuit incorporating a safety valve. The resulting simple safety system enables the lower part to retract if it encounters abnormal resistance.

Of course, if the machine continues to move forward it may still be damaged. To prevent this an electrical alarm circuit is preferably adapted to operate an alarm device if the lower part encounters a resistance exceeding a threshold resistance.

As a further measure to prevent the machine picking up sand, variable intensity shaker means are preferably provided on the two apron parts.

The variable intensity shaker means preferably comprise shafts rotated by motors and incorporating bosses adapted to contact flexible strips supporting bars forming the grid conveyors and idler rollers on a tilting mount with control means whereby they can cooperate with the strips to move them away from the bosses to be retracted.

In other words, the variable intensity shaker comprises at least one shaft rotated by at least one motor, with the at least one shaft including at least one boss adapted to contact at least one flexible strip supporting bars forming the two-part motor driven first grid conveyor, at least one idler roller on a tiltable mount, and a control mechanism for controlling tilting of the tiltable mount, whereby the at least idler roller can cooperate with the at least one flexible strip to move the at least one idler roller away form or towards the at least one boss.

The rollers are preferably carried by yokes disposed radially on a rotatable shaft carrying laterally a second yoke connected to the apron by a ram adapted to modify the angular position of the rotatable shaft.

To prevent clogging of the machine and to enable small items of detritus to be picked up, the grid conveyors of the apron parts preferably comprise a mesh extending over all of the surface thereof and fixed by wires wound helically onto the bars of the grid conveyors and whose turns are interengaged with some loops of the mesh.

The lower part preferably comprises a frame supporting two wheels disposed one on each side of the apron. The frame is pivotable about an axis perpendicular to the direction of forward movement of the machine, and rams are provided for pivoting it.

The frame preferably comprises means for retracting the wheels. These means can include various mechanisms for moving the wheels. Preferably, the means for retracting the wheels comprise two arms pivoted to shafts carried by yokes provided on the apron, rams being disposed between the apron and the arms which each comprise at their free end a yoke supporting a shaft to which is pivoted a bar whose free end supports a shaft to which is pivoted a frame carrying the wheel, means being provided for locking the bars in an operative configuration of the machine so that the wheels lie one on each side of the apron or in a transport configuration so that the wheels are stowed over the apron. In this way a machine can be constructed to operate over a great width but still can comply with road traffic regulations.

The means for locking the bars preferably comprise two holes in the yoke, one on each side of the shaft, each bar having a hole adapted to be selectively aligned with the holes in the yoke and a pin being provided for insertion through the aligned holes.

To enable the machine to remove large heaps of material the second grid conveyor preferably comprises teeth in addition to paddles. The teeth are preferably resiliently mounted.

BRIEF DESCRIPTION OF THE DRAWINGS

The invention will now be described in more detail with reference to a specific embodiment shown by way of example only in the appended drawings, wherein:

FIG. 2 is a schematic perspective view of part of the machine.

FIG. 10 is a diagram showing a safety system of the lower part of the apron.

DETAILED DESCRIPTION OF THE INVENTION

Figure 1:
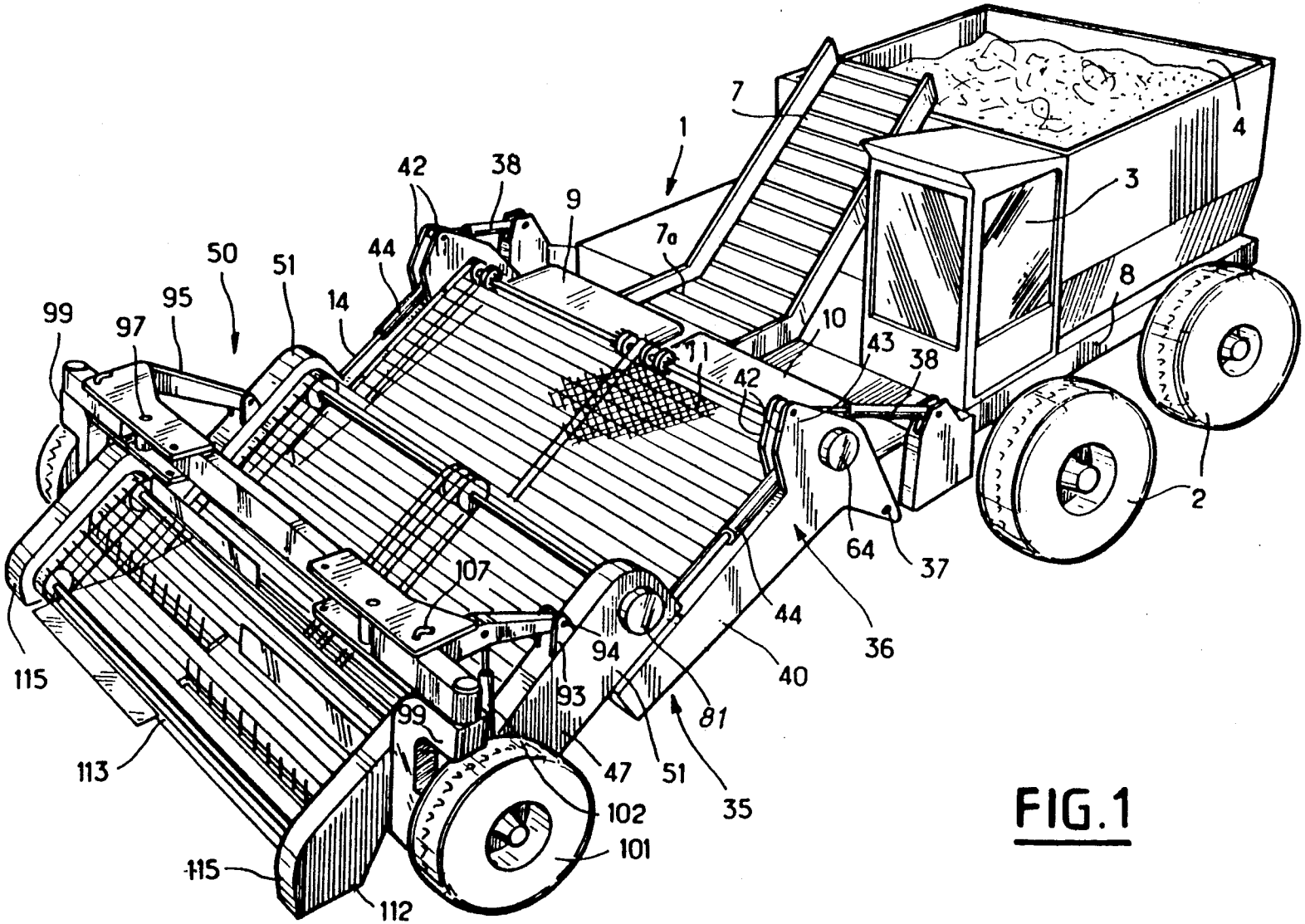
FIG. 1 is a perspective view of the machine in accordance with the invention.

The machine shown in the various figures comprises a self-propelled vehicle 1 supported on four driven wheels 2 of which two are steerable.

The vehicle has a cab 3 in which the various controls of the machine are housed.

To the rear of the cab 3 on a chassis 8 is a tilting skip 4 into which a conveyor belt 7 discharges.

The conveyor belt 7 has a part 7*a* located underneath two endless belts 9 and 10.

As illustrated in FIG. 2, the conveyor belt 7 is driven by a motor 15. A shaft 11 coupled to a motor 12 carries two sprocket wheels 14 and 16. The sprocket wheel 14 drives a chain 17 which drives a sprocket wheel 18 of an angle-changer unit 19 whose output sprocket wheel 20 drives a chain 21 driving a sprocket wheel 22 driving the belt 10.

The sprocket wheel 16 drives a chain 27 driving a sprocket wheel 28 of an angle-changer unit 29 whose output sprocket wheel 30 drives a chain 31 driving a sprocket wheel 32 driving the belt 9.

An apron 35 of the machine lies on the upstream side of the belts 9 and 10. It comprises two parts 36 and 50, the first part 36 pivoting on shafts 37 and being coupled to the chassis 8 by rams 38.

The first part 36 is in the form of two beams 40 supporting a grid conveyor 71. Each beam has two flanges 42 in between which the cylinder of a ram 44 is articulated to a shaft 43.

Figure 5:
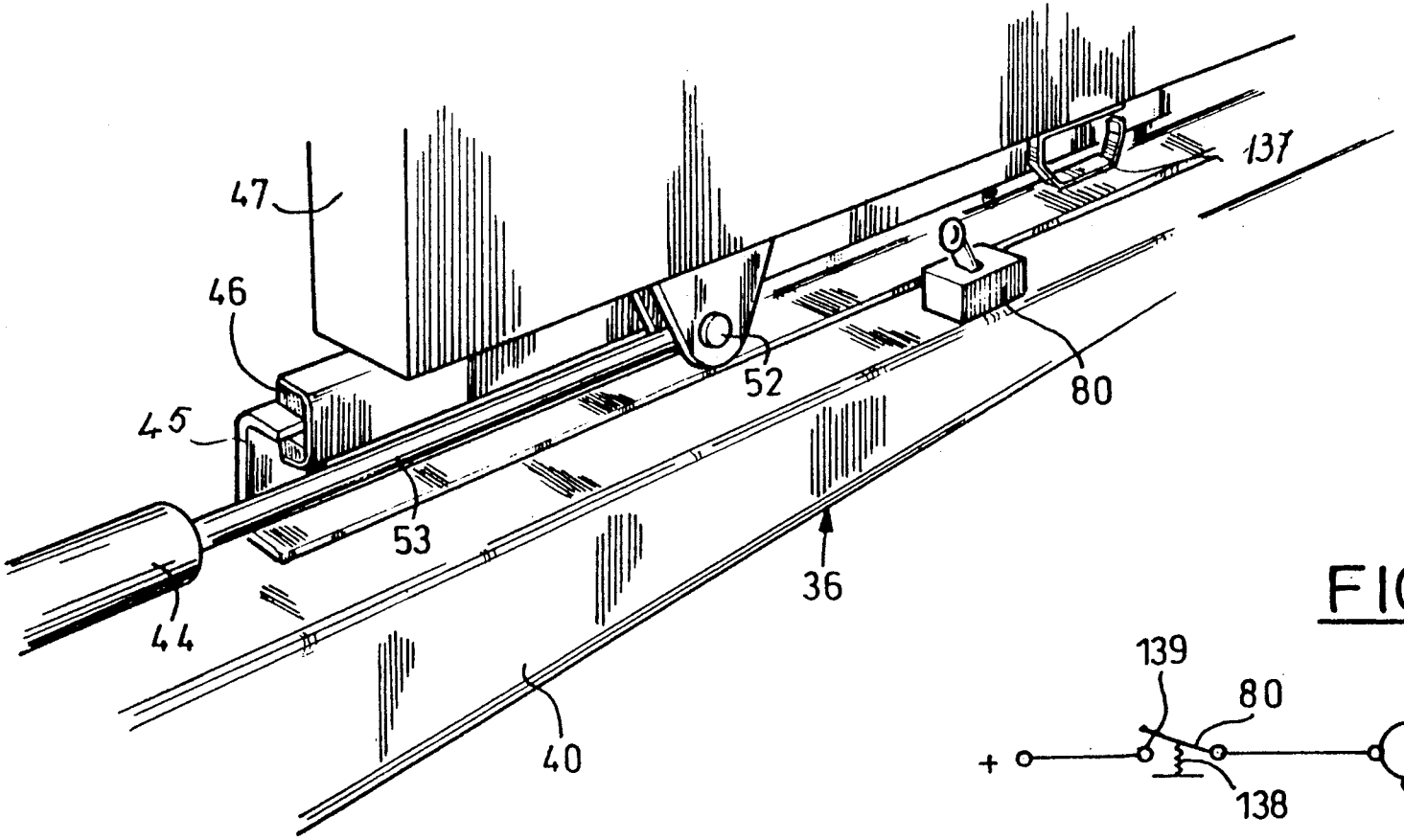
FIG. 5 shows part of a guidance system for a lower part of an apron.

Each beam 40 (see FIG. 5) comprises slideways 45 guiding skids 46 of a frame 47 supporting the second part 50 of the apron 35.

This second part 50 comprises two supports 51 fitted with the skids 46 and each provided with a shaft 52 to which is fixed the free end of the piston rod 53 of the ram 44. The frame 47 can therefore occupy either the position shown in FIG. 3 or that shown in FIG. 4.

The rams 44 (see FIG. 10) are double-acting rams and are included in a hydraulic circuit comprising a tank 55, a pump 56 aspirating oil from the tank and feeding it to a distributor 57 adapted to free the ram 44 selectively via pipes 59 and 60 either on the side of the piston attached to the piston rod 53 or on the free side of the piston, and a return pipe 61 to the tank 55 to enable oil to be returned to the tank from the chamber of the ram 44 which is no longer pressurized. The pipe 60 includes a safety valve 63 connected by a pipe 64 to the pipe 61 The safety valve 63 is calibrated so that if the lower end of the second part 50 of the machine meets a resistance exceeding a predetermined threshold, the frame 47 can slide against the action of the rams 44 to prevent damage to the machine. An additional safety system is provided to warn the driver.

It is conceivable that the second part 50 of the machine could encounter an abnormal resistance so that the frame 47 slides against the action of the rams 44 without the driver noticing. In this event, further forward movement of the machine could seriously damage it.

To avoid this drawback one of the beams 40 is fitted with a switch 80 in an alarm circuit 136 connected to an electric bell 89.

Figure 7:
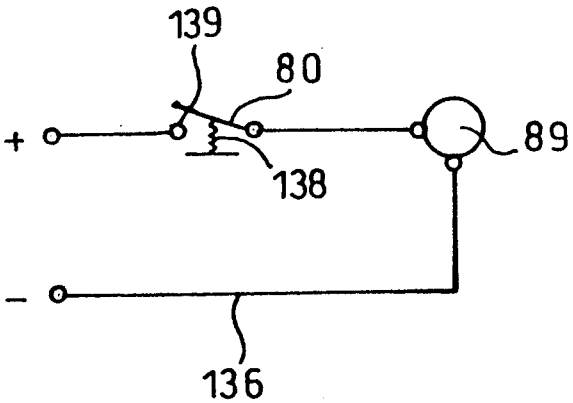
FIG. 7 is an electric circuit diagram of a safety system.

The frame 47 carries a boss 137 disposed to engage the switch 80 which is a normally open switch in which a spring 138 holds apart two contacts 139 closing the circuit 136 to the bell 89 (see FIG. 7).

If on meeting an abnormal resistance the part 50 of the machine slides back over a distance greater than that defined by the position of the boss 137 the latter operates the switch 80 to close the circuit 136 to the bell 89 to attract the attention of the driver.

Figure 11:
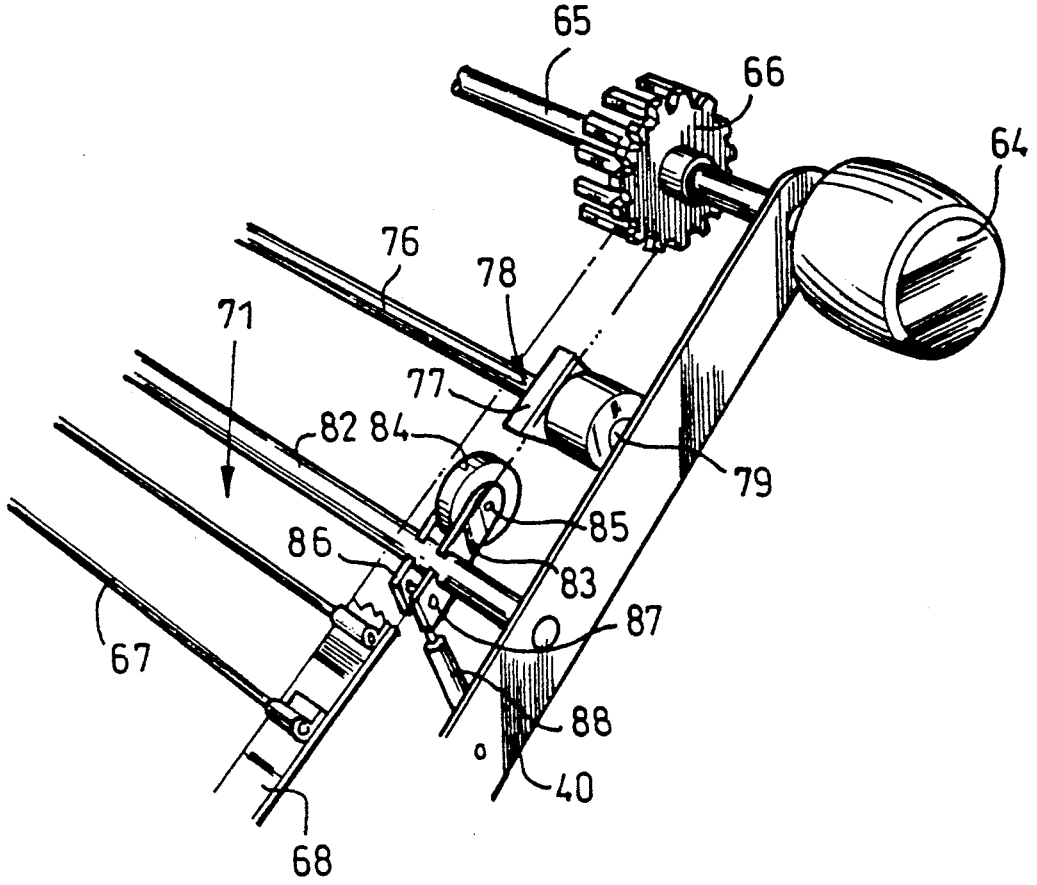
FIG. 11 shows part of a system for adjusting the intensity of shaker means.

The part 36 of the apron 35 includes a motor 64 driving a shaft 65 to which are keyed sprocket wheels 66 adapted to cooperate with bars 67 linked together by flexible strips 68 (see FIG. 11) and constituting a grid conveyor 71. An idler shaft 69 is provided at the lower end of the part 36 and sprocket wheels 70 of the same kind as the sprocket wheels 66 are keyed to it and guide said conveyor (see FIG. 3).

The second part 50 of the machine comprises a grid conveyor 72 and two shafts 73 and 74 to which are respectively keyed sprocket wheels 75 and 76 of the same kind as the sprocket wheels 66 which cooperate with the bars of the conveyor 72. The shaft 73 is driven by a motor 81 (see FIGS. 3 and 4).

A shaker device 78 is disposed underneath the grid conveyor 71. It includes a shaft 76 incorporating bosses 77 under the flexible strips 68. The shaft 76 is driven by an independent motor 79. The bosses 77 bear against the lower surface of the flexible stirps 68 to shake the grid conveyor 71.

Adjacent the shaft 76 is a shaft 82 mounted on the beams 40 and carrying radial yokes 83 whose branches support a shaft 85 carrying an idler roller 84. The shaft 82 carries a second yoke 86 whose branches support a shaft 87 connected to the free end of the piston rod of a ram 88 whose cylinder is articulated to the respective beam 40.

The rollers 84 can therefore be applied to the lower surface of the flexible strips 68 in order to move them away from the bosses in order to reduce the intensity of the shaking action or even eliminate it completely. The rollers 84 can also be retracted (i.e., moved away from the flexible stirps 68) in which case the shaking intensity is at its maximum (see FIG. 11).

A shaker system whose intensity can be varied in amplitude and in frequency is provided for the grid conveyor 72 of the second part 50 of the machine. This shaker system is of the same kind as that just described with respect to the first part 36, and is not described in detail here.

Figure 12:
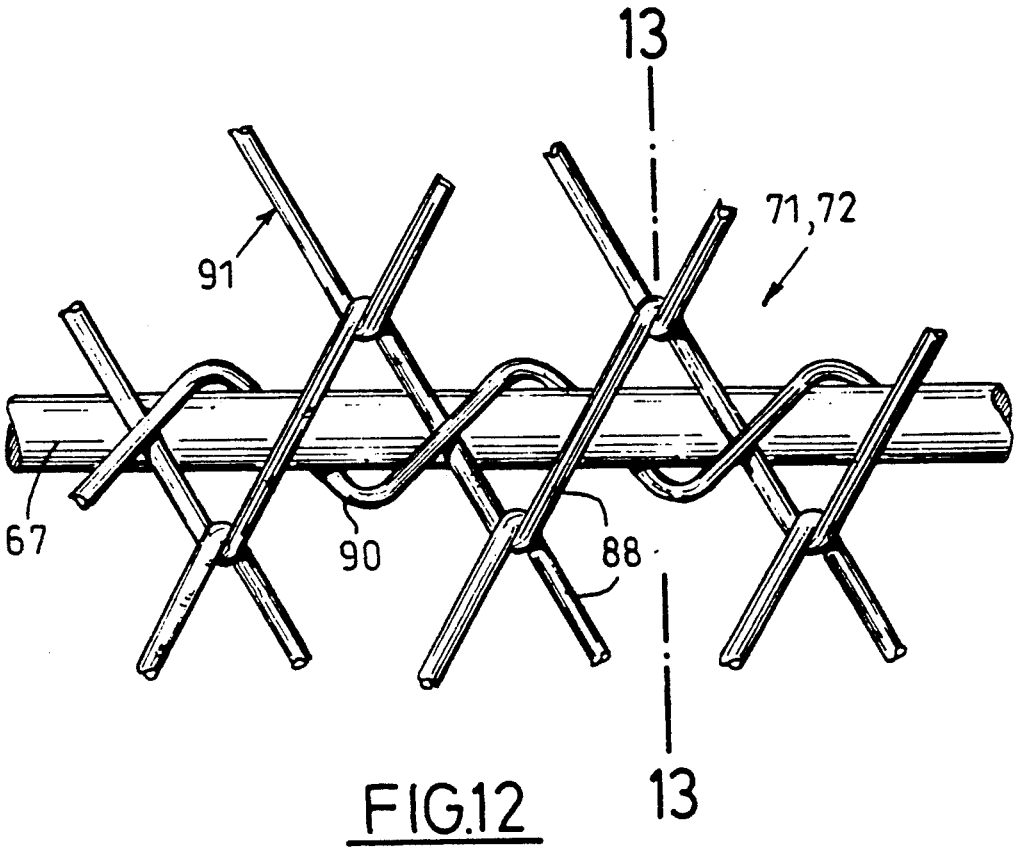
FIG. 12 is a perspective view showing to a larger scale how the grid conveyors are secured to the apron.
Figure 13:
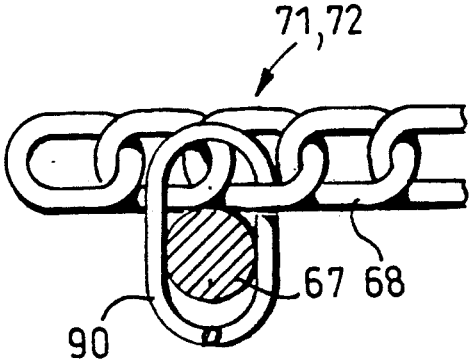
FIG. 13 is a view in cross-section on line 13—13 in FIG. 12.

To enable the conveyors 71 and 72 to handle small pieces of detritus and to prevent clogging of the machine the grid conveyors are covered with a mesh 91 (see FIGS. 12 and 13) extending the full width of the conveyor.

Wires 90 are wound helically around some of the bars 67. Each turn is oval in shape with a projecting part which passes over the parts 88 of one loop of the mesh. In this way the mesh 91 is attached to the bars 67 in a flexible manner and with some capacity for sliding.

This is a very simple and very quick way to fit the mesh 91 which can operate perfectly as the conveyor rotates.

A mesh 91 is fitted to the grid conveyor 72 in the same way.

Figure 6:
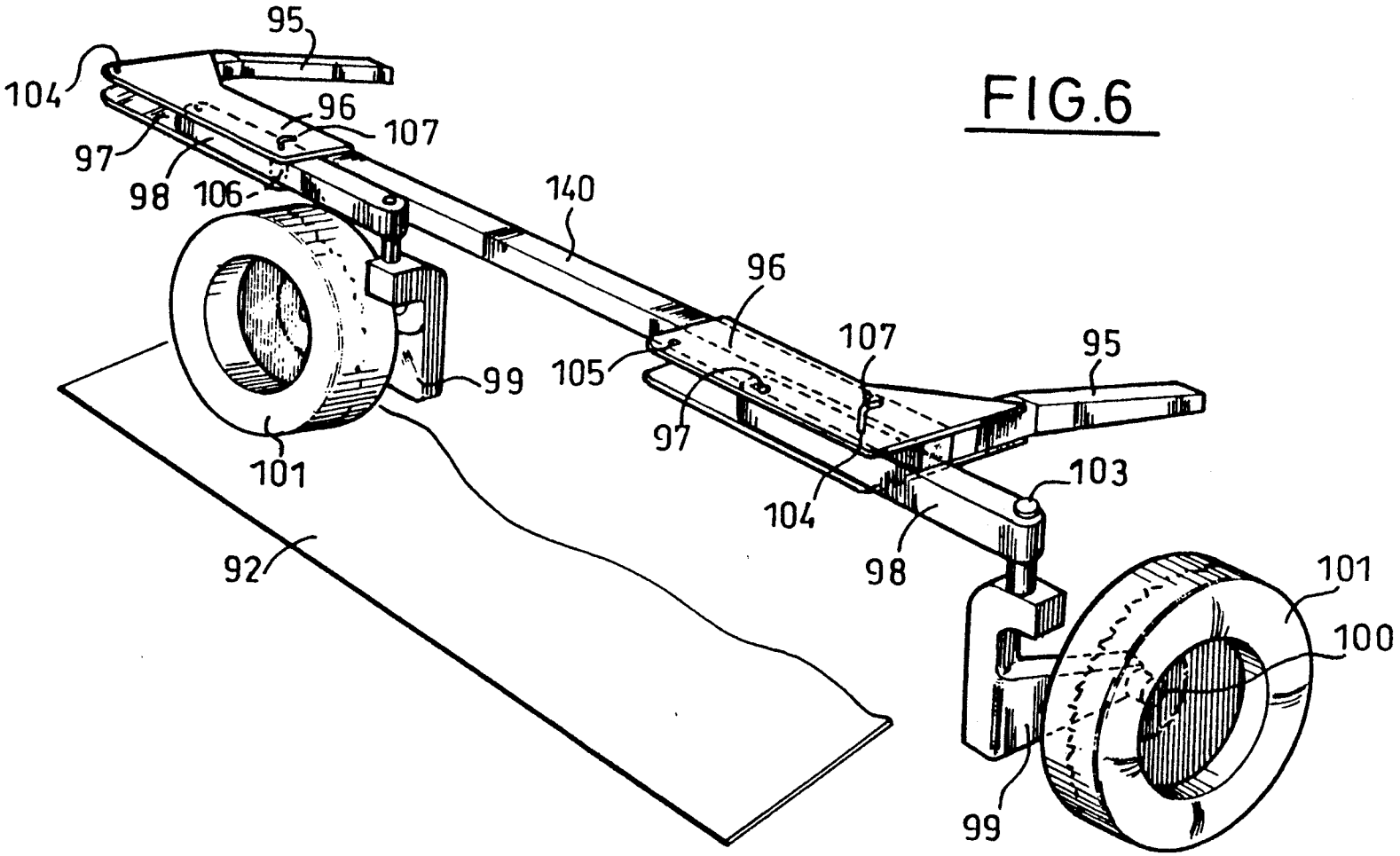
FIG. 6 shows part of a frame supporting wheels which support the apron of the machine.

The lower ends of the supports 47 are joined together by a blade 92 designed to dig into the sand and each support comprises a yoke 93 supporting a shaft 94 to which is pivoted an arm 95 whose free end is attached to a yoke 96 supporting a shaft 97 to which is pivoted a bar 98 whose free end supports a shaft 103 to which is pivoted a frame 99 carrying a shaft 100 on which is mounted an idler wheel 101 (FIG. 6).

A ram 102 is provided between each arm 95 and the respective support 47. Two holes 104 and 105 are provided in the yoke 96. A hole 106 in the bar 98 can be aligned selectively with the holes 104 and 105, a pin 107 being provided for locking the bar 98 in the required position by insertion of the pin into the holes 104 or 105 and 106.

To stiffen the assembly comprising the arms 95 a beam 140 links the yokes 96 together.

In operation, the bars 98 are disposed so that the holes 106 align with the holes 104 and the pins 107 are inserted in the aligned holes; the front part of the apron is then supported by the wheels 101.

The width between the wheels 101 is too large for the machine to travel by road. To work on beaches it is desirable for the apron to be as wide as possible, although this is incompatible with road traffic regulations. To use roads the rams 102 are operated to raise the arms 95 after which the pins 107 are removed and the bars 98 are rotated about the shafts 97 until the wheels 101 lie within the space delimited by the apron in which position the bars 98 are locked by inserting the pins 107 into the aligned holes 105 and 106.

A link 111 is pivoted to a shaft 110 on each support 47. Its other end is pivoted to a frame 112 of a second grid conveyor 113. The second grid conveyor 113 has two slide members 115 supporting two shafts 116 and 117, the shaft 116 being coupled to a motor 120 and sprocket wheels of the same type as the sprocket wheels 66 being keyed to the shaft and cooperating with bars 118 attached to flexible strips 119.

A ram 121 is provided between each link 111 and the respective support 47. Rams 122 are provided between the lower ends of the supports 47 and the slide members 115, near the lower end of the latter. It is therefore possible to advance the second grid conveyor 113 and also to raise its front end as appropriate to the height of the heaps of detritus to be picked up.

Figure 3:
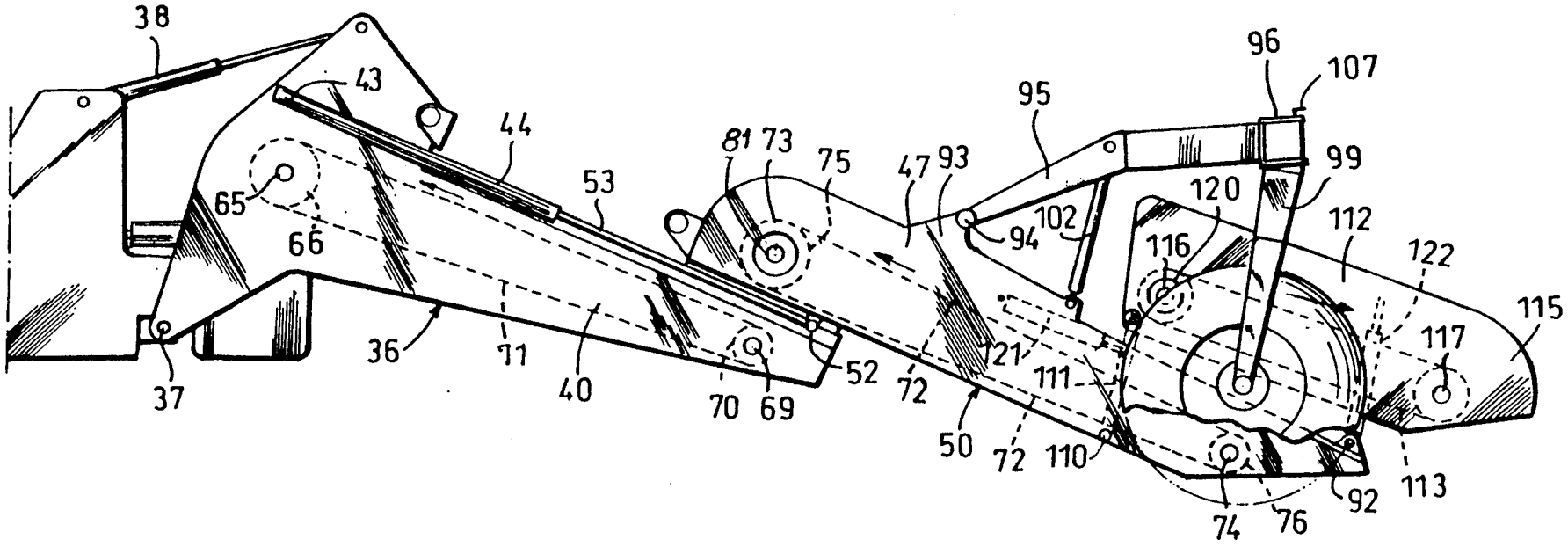
FIG. 3 is a view in elevation showing a front part of the machine in the operative position.
Figure 4:
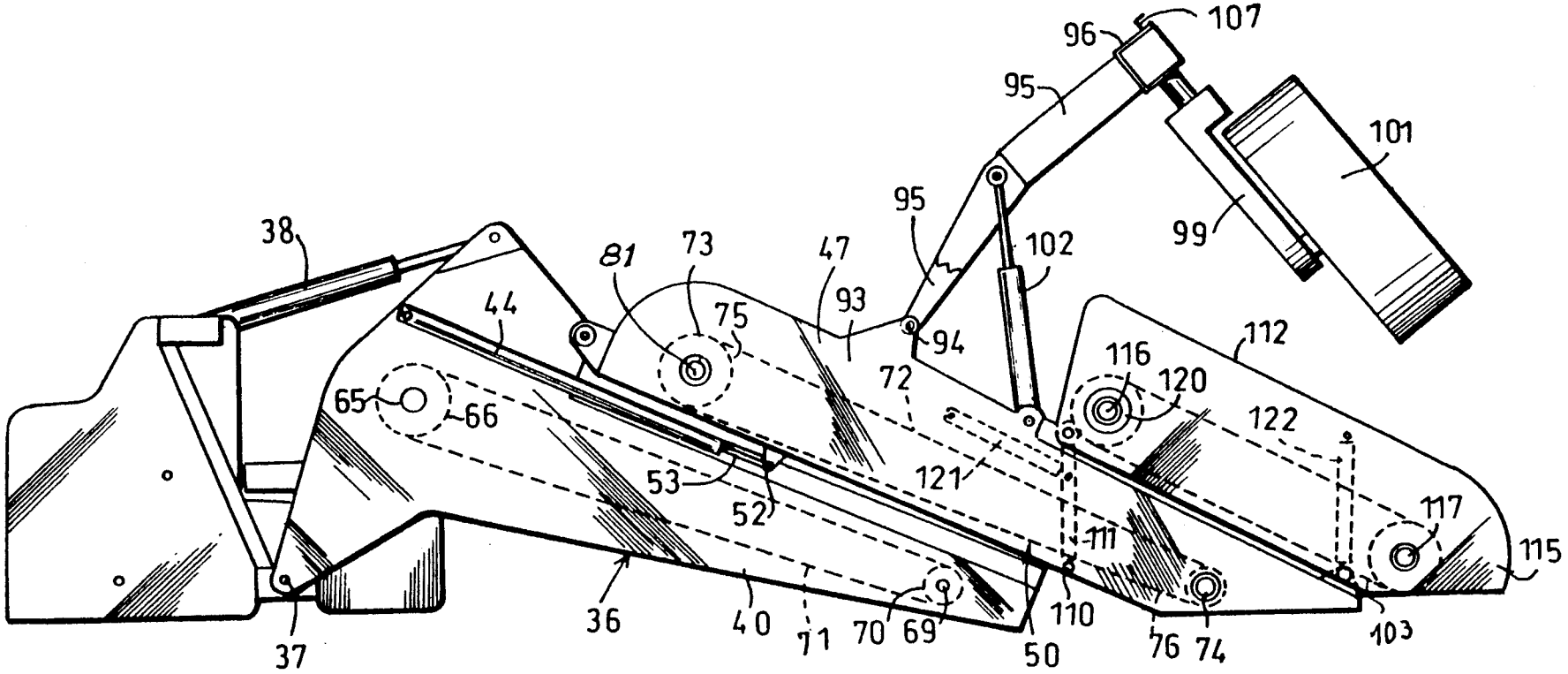
FIG. 4 is a view similar to FIG. 3 showing the front part in the road transport position.

The conveyors 71 and 72 turn in the direction of the arrows shown in FIG. 3 and can turn at different speeds because they are driven by independent motors. The second grid conveyor 113 turns in the direction of the arrow (see FIG. 3) and its speed can be different from that of the other two conveyors 71 and 72 because it is driven by an independent motor.

Figure 8:
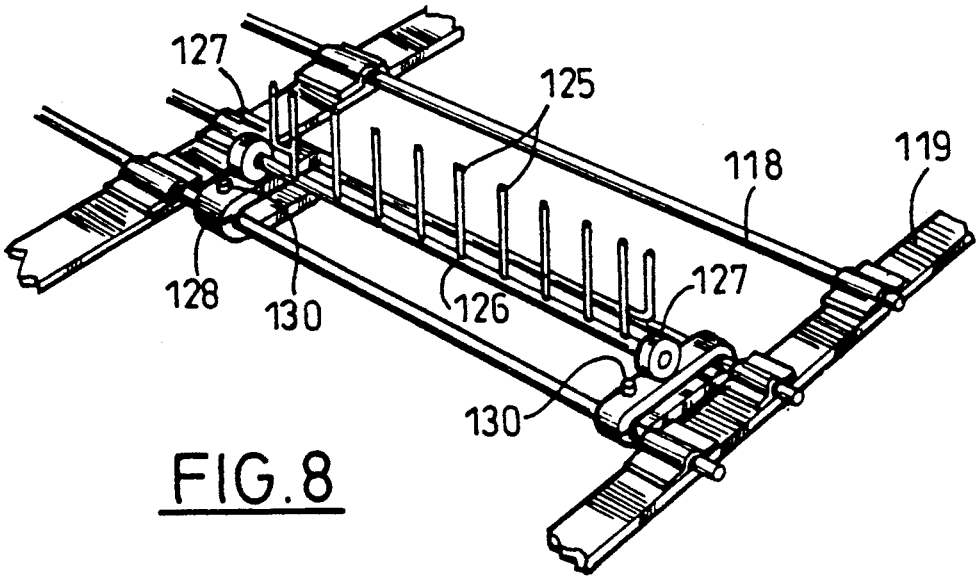
FIG. 8 is a perspective view showing part of a second grid conveyor.

Teeth 125 may be fixed to some bars 118 to facilitate the breaking up of heaps of detritus (see FIG. 8). These teeth are fastened radially to a bar 126 whose end comprises elastic mounting blocks 127 enabling the bar 126 to pivot if the teeth 125 encounter excessive resistance, the elastic blocks 127 returning the bar 126 to its original position when the teeth are no longer loaded.

The elastic blocks 127 are carried by clamps 128 surrounding two contiguous bars 118 and fastened together by bolts 130.

Figure 9:
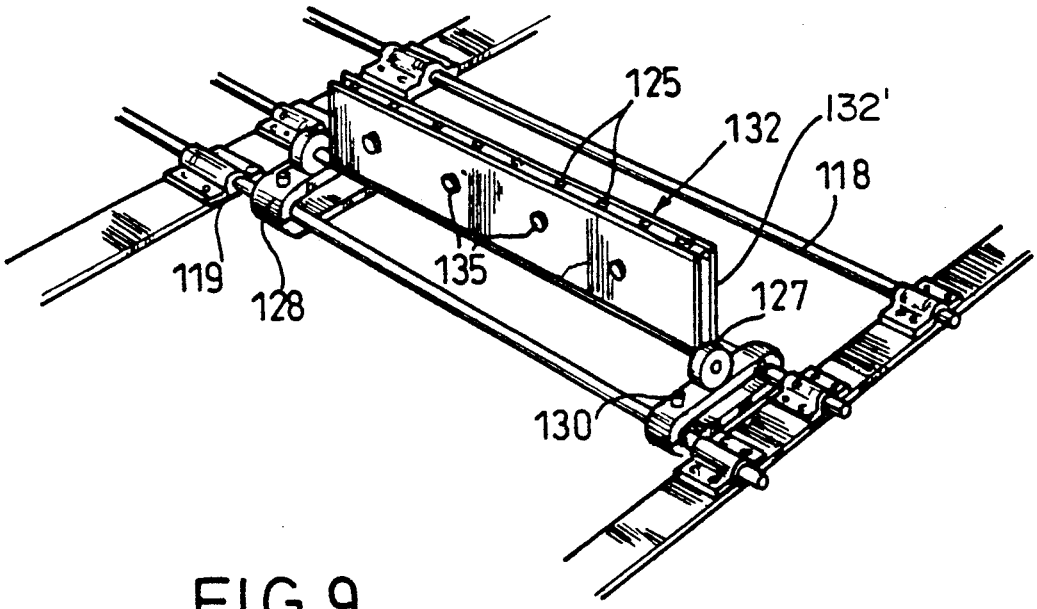
FIG. 9 is a perspective view showing part of a paddle of the second grid conveyor.

The teeth 125 are used to break up heaps of detritus. To facilitate the passing of some kinds of detritus to the grid conveyor 72 it is advantageous for the teeth 125 to alternate with paddles 132 (see FIG. 9), formed by pairs of sheet metal plates 132 clamped to the teeth 125 by bolts 135.

When the machine is operated to clean a beach it is in the configuration shown in FIG. 1.

The height of the blade 92 is adjusted using the rams 38 and the rams 102 so that the blade digs a little way into the sand to pick up buried objects near the surface. The grid conveyors 71 and 72 and the second grid conveyor 113 are driven so that the detritus is transported by the grid conveyor 72, the teeth 125 and the paddles 132 of the second grid conveyor 113 playing their part. The detritus rolls and is shaken on the conveyor 72 so that at least some of the sand adhering to it is shaken off although some kinds of detritus, such as flat and elongate seaweed, for example, retain a significant amount of sand on the surface that is not in contact with the grid conveyor 72. When the detritus reaches the upper end of the conveyor 72, it is turned over as it falls onto the conveyor 71 so that the side which was not in contact with the conveyor 72 is then in contact with the conveyor 71. This arrangement eliminates the sand. The detritus then drops onto the belts 9 and 10 and from there onto the conveyor belt 7 from which it is discharged into the skip 4.

When the machine is to travel by road, each pin 107 is removed, the arms 95 are raised by the rams 102 and the bars 98 are turned about the shafts 97 until the wheels 101 are above the grid conveyor. The arms 98 are locked in this position by inserting the pins 107 into the holes 105 after which the arms 95 are lowered so that the wheels rest on the conveyors. The supports 47 are displaced by the rams 44 until the grid conveyor 72 overlies the grid conveyor 71, which may be raised by the rams 38 (see FIG. 4).

This application is related to corresponding French Application No. 91 01 275, filed Feb. 5, 1991, whose priority is claimed, the disclosure and drawings of which are incorporated by reference thereto in their entirety.

Of course, the invention is not limited to the embodiment described and shown. Numerous modifications of detail may be made thereto without departing from the scope of the invention.

What is claimed is:

1. Beach cleaning machine comprising:

a self-propelled vehicle carrying a tippable skip, a front-mounted apron in having an upper apron part and a lower apron part each comprising a respective portion of a two-part motor-driven first grid conveyor, and a blade at a lower forward end of said lower apron part adapted to dig into sand;

said lower apron part having an upper rear and overlying said upper apron part with said lower apron part being slidably mounted;

displacement means for moving said lower apron part relative to said upper apron part between an operative position in which said lower apron part and said upper apron part are disposed one substantially in front of the other, and a transport position in which said lower apron part and said upper apron part are substantially stacked one on top of the other;

a conveyor belt discharging into said skip and onto which said first grid conveyor discharges; and a second grid conveyor above and adapted to be driven in an opposite direction to said first grid conveyor, paddles on said second grid conveyor, links pivoted at one end to said second grid conveyor and at the other end to said front-mounted apron, rams adapted to displace said links and rams operative between said front-mounted apron and a lower end of said second grid conveyor.

2. Machine according to claim 1, wherein said displacement means for displacing said lower apron part relative to said upper apron part comprise rams disposed between said upper apron part and said lower apron part.

3. Machine according to claim 2, wherein said rams disposed between said upper apron part and said lower apron part are included in a circuit incorporating a safety valve.

4. Machine according to claim 1, including an electrical alarm circuit adapted to operate an alarm device when said lower part encounters a resistance exceeding a threshold.

5. Machine according to claim 2, including an electrical alarm circuit adapted to operate an alarm device when said lower part encounters a resistance exceeding a threshold.

6. Machine according to claim 3, including an electrical alarm circuit adapted to operate an alarm device when said lower part encounters a resistance exceeding a threshold.

7. Machine according to claim 1, including a variable intensity shaker associated with said lower apron part and said upper apron part.

8. Machine according to claim 7, wherein said variable intensity shaker comprises at least one shaft rotated by at least one motor, with said at least one shaft including at least one boss adapted to contact at least one flexible strip supporting bars forming said two-part motor driven first grid conveyor, at least one idler roller on a tiltable mount, and a control mechanism for controlling tilting of said tiltable mount, whereby said at least idler roller can cooperate with said at least one flexible strip to move said at least one idler roller away from or towards said at least one boss.

9. Machine according to claim 8, wherein said tiltable mount comprises a yoke radially disposed on a rotatable shaft carrying a laterally disposed second yoke connected to said front-mounted apron by a ram adapted to modify the angular position of said rotatable shaft.

10. Machine according to claim 6, including a variable intensity shaker associated with said lower apron part and said upper apron part.

11. Machine according to claim 1, wherein said two-part motor-driven first grid conveyor comprises a mesh extending over all of the surface thereof, and said mesh being fixed by wires wound helically onto bars of said two-part motor-driven first grid conveyor, and turns of said wire being interengaged with some loops of said mesh.

12. Machine according to claim 1, wherein said lower part comprises a frame supporting two wheels disposed one on each side of said front-mounted apron, said frame being pivoted about an axis perpendicular to a direction of forward movement of the machine, and including rams for pivoting said frame.

13. Machine according to claim 12, wherein said frame comprises means for retracting said wheels.

14. Machine according to claim 13, wherein said frame comprises two arms pivoted to shafts carried by yokes on said front-mounted apron, rams disposed between said front-mounted apron and said two arms, each of said two arms comprise at a free end a yoke supporting a shaft to which is pivoted a bar having a free end supporting a shaft to which is pivoted a frame carrying one of said two wheels, means for locking said bar in an operative configuration of the machine so that said two wheels lie one on each side of said front-mounted apron or in a transport configuration so that said wheels are stowed over said front-mounted apron.

15. Machine according to claim 14, wherein said means for locking said bar comprise two holes in said yoke, one on each side of said shaft, each bar having a hole adapted to be selectively aligned with said two holes in said yoke, and a pin for insertion through the aligned holes.

16. Machine according to claim 1, wherein said second grid conveyor further includes teeth.

17. Machine according to claim 16, wherein said teeth are resiliently mounted.

* * * * *